US006960367B2

(12) United States Patent
LaFay et al.

(10) Patent No.: US 6,960,367 B2
(45) Date of Patent: Nov. 1, 2005

(54) SANDCASTING PATTERN COATING COMPOSITIONS

(75) Inventors: Victor Steven LaFay, Cincinnati, OH (US); Stephen Louis Neltner, Alexandria, KY (US)

(73) Assignee: The Hill And Griffith Company, Cincinnati, OH (US)

( * ) Notice: Subject to any disclaimer, the term of this patent is extended or adjusted under 35 U.S.C. 154(b) by 166 days.

(21) Appl. No.: 10/072,638

(22) Filed: Feb. 7, 2002

(65) Prior Publication Data

US 2002/0168465 A1 Nov. 14, 2002

Related U.S. Application Data

(60) Provisional application No. 60/267,061, filed on Feb. 7, 2001.

(51) Int. Cl.[7] ..... B05D 1/00
(52) U.S. Cl. ..... 427/134
(58) Field of Search ..... 427/133, 134

(56) References Cited

U.S. PATENT DOCUMENTS

| | | | | |
|---|---|---|---|---|
| 4,142,003 | A | | 2/1979 | Sejpal |
| 4,155,770 | A | | 5/1979 | Doumani |
| 4,522,250 | A | * | 6/1985 | Laemmle et al. ..... 164/472 |
| 4,676,997 | A | | 6/1987 | LaFay et al. |
| 4,740,324 | A | | 4/1988 | Schur |
| 5,100,697 | A | | 3/1992 | Nielsen |
| 5,194,584 | A | | 3/1993 | Leahy |
| 5,374,303 | A | | 12/1994 | van Hoorn |
| 5,378,270 | A | | 1/1995 | Takashima |
| 5,474,604 | A | | 12/1995 | Demmering et al. |
| 5,494,502 | A | | 2/1996 | DeLong |
| 5,605,953 | A | | 2/1997 | Esser |
| 5,626,656 | A | | 5/1997 | Kondo et al. |
| 5,647,899 | A | | 7/1997 | Lightcap, Jr. |
| 5,691,285 | A | | 11/1997 | Coffey et al. |
| 5,709,739 | A | | 1/1998 | Wittich et al. |
| 5,900,048 | A | | 5/1999 | Olson et al. |
| 5,900,456 | A | | 5/1999 | Hashiuchi et al. |
| 6,126,757 | A | | 10/2000 | Kinnaird |
| 6,326,429 | B1 | | 12/2001 | Sturgis et al. |

FOREIGN PATENT DOCUMENTS

| | | |
|---|---|---|
| CN | 1066613 | * 12/1992 |
| CN | 1069432 | * 3/1993 |
| GB | 1165807 | * 10/1969 |

OTHER PUBLICATIONS

Translation of CN 1069432, Mar. 1993.*
Translation of CN 1066613, Dec. 1992.*
*F–500 Enviro Form Release Super Concentrate*, Specco Industries, Inc. web site (Jun. 18, 2001).

* cited by examiner

*Primary Examiner*—Erma Cameron
(74) *Attorney, Agent, or Firm*—Thompson Hine LLP

(57) ABSTRACT

Sand casting is an old art. In this molding process sand is compacted around a pattern and the pattern is removed, leaving a mold cavity the shape of the pattern. Molten metal can then be poured into the cavity to form the object. To increase the life of the mold, and to make removal of the pattern easier, the pattern must be coated with a protective material. Despite many available pattern coating compounds, mineral seal oil, and a mixture of mineral seal and clay, have been the commercial choices. Hereby the advantages of mineral seal oil-clay pattern coating compositions are retained without its detriments by utilizing a vegetable oil base in a pattern coating composition to replace some or all of the mineral seal oil to provide biodegradable coating compositions with reduced VOC content.

22 Claims, No Drawings

SANDCASTING PATTERN COATING COMPOSITIONS

CROSS-REFERENCE TO RELATED APPLICATION

This application claims priority from U.S. Provisional Application No. 60/267,061, filed Feb. 7, 2001.

BACKGROUND OF THE INVENTION

This invention pertains to the casting of metals in sand molds, and particularly to methods and materials for increasing the lives of the mold patterns which are employed therein.

The introduction of a molten metal into a cavity, or mold, where upon solidification, the resulting casting becomes an object whose shape was determined by the mold, is an old art. Equally as old is sand casting. In this molding process a wood, metal or plastic pattern is fabricated in the shape of the part to be produced. Sand is then compacted around the pattern in such a way that the top portion of the mold and the pattern can be removed, leaving a mold cavity in the shape of the pattern. Molten metal is then poured into the mold cavity.

It is well known that to increase the life of a mold and to make the removal of the casting easier, the surfaces of the mold cavity must be coated with a protective material. In the case of sand castings however it is the pattern which must be coated. Prior art coating compositions however deal primarily with mold coatings rather than pattern coatings.

Coatings for foundry cores and molds are basically mold release agents. They are used to obtain smoother casting surfaces with fewer defects. In its simplest form such a coating is simply a suspension of bentonite, kaolin and other members of the montmorillonite group of clays in water. As in the case of moldings, the use of sandcasting patterns is not without its own problems. The pattern surfaces erode and pit when successive mold cavities are produced using them. When such erosion occurs, molding sands have a greater tendency to adhere to the pattern when it is removed, affecting the mold cavity. Pattern release coatings in accordance with the present invention provide improved release properties and increase the number of molds/application. Accordingly, in spite of available pattern coating compositions, mineral seal oil and mineral seal oil-clay coatings are still the commercial preference.

SUMMARY OF THE INVENTION

The present invention relates to a method of protecting foundry molds from eroding and pitting during sand casting by preventing adherence of casting sand to surfaces of casting patterns using a biodegradable and low VOC (volatile organic compound) pattern coating composition. In accordance with one aspect of the invention, the method involves applying a vegetable oil-clay composition to the surfaces of a casting pattern in an amount sufficient to form a coating which prevents that adherence and affords that protection. The pattern coating composition in accordance with a particular embodiment of the invention is an emulsified vegetable oil, and the clay incorporated therein is an organophylic clay, included in the coating as such or as a clay-water dispersible amine mixture. The emulsion, then, is a 40/60 to 60/40 by weight oil-water emulsion.

In accordance with another embodiment of the present invention, a simple blend of vegetable oil with petroleum oils and/or alcohol is provided as a pattern coating composition. The pattern coating composition in accordance with this embodiment is also biodegradable and has a low VOC content.

DETAILED DESCRIPTION OF THE INVENTION

This invention relates to an improvement of the processes for coating sand casting patterns with a pattern coating composition wherein the pattern coating compositions are biodegradable with a low VOC content. The pattern coating composition in accordance with one embodiment is prepared by forming an aqueous emulsion of a vegetable oil using a water dispersible amine and a clay reactive therewith as emulsifiers. It will be appreciated that the amine and the clay react to form an organophylic clay, the quantity of organophylic being sufficient to stabilize the emulsion, generally two to five weight percent organophylic clay based on the weight of the oil-water mixture. The oil and water emulsion of this embodiment presents no volatility and no flash point problems. Furthermore, in lieu of a clay and a dispersible amine, an organophylic clay can be used to stabilize the emulsion.

In accordance with another embodiment, the pattern coating composition is prepared by blending a vegetable oil with a viscosity reducing additive. Examples of useful viscosity reducing additives include petroleum oils and alcohols. The viscosity reducing additives can be used alone or in combination to provide a composition having the desired viscosity, biodegradability, release properties and VOC level.

Vegetable oils useful in the present invention are not particularly limited. In general, any vegetable oil may be used. Examples of vegetable oils useful in the present invention include, but are not limited to, corn oil, sesame oil, rapeseed oil, sunflower oil, palm oil, olive oil, coconut oil, peanut oil, soybean oil, canola oil. Corn oil is particularly useful.

The viscosity of corn oil is typically around 60–90 cps, typically 70 cps, whereas mineral seal oil used in prior art methods has a viscosity from about 7 to 27 cps. Therefore, it may be desirable to reduce the viscosity of the vegetable oil base by blending the oil with a viscosity decreasing additive. The viscosity of the vegetable oil base can be reduced by blending with a lower viscosity material, such as a petroleum oil, preferably a mineral seal oil, or an alcohol. Alcohols are particularly useful in reducing the viscosity of the vegetable oil. Alcohols also improve leveling of the coating thereby providing a smoother, more uniform surface. Typically, the coating composition of the present invention has a viscosity of between about 10 and 100 cps at 25° C. In more particular embodiments of the present invention, the viscosity of the coating composition is between about 15–50 cps. The viscosity of the coating composition can also extend beyond these ranges depending on the particular application method.

Useful alcohols include straight or branched chain alcohols having from 1 to 4 carbon atoms. Illustrative alcohols include methanol, ethanol, isopropanol, n-propanol, isobutanol, t-butanol, etc. Although methanol could be used as a viscosity reducer, it is not recommended because of its associated toxicity. Ethanol, particularly corn alcohol, is a particularly useful alcohol for reducing the viscosity of a corn oil.

The amount of alcohol used is the amount required to reduce the vegetable oil viscosity to the desired level. The amount of alcohol, when present, can range from 0.5 to 10% based on the total weight of the composition. Corn oil and corn alcohol are typically used at a ratio of 95 to 5, but can range from pure corn oil to about 90% corn oil and about 10% corn alcohol. Other vegetable oils and alcohols may be used at similar levels.

The pattern coating composition of the present invention may comprise petroleum oil as a viscosity reducer blended with vegetable oil. A blend of petroleum oil and vegetable oil is advantageous in that the vegetable oil naturally contains fatty acids. Therefore, it is not necessary to separately add fatty acids during preparation of the pattern coating composition to obtain desired release properties. Blends prepared in accordance with this embodiment of the invention typically contain from about 10% to 90% petroleum oil based on the total weight of the composition.

Although fatty acids are not required to be added in the pattern coating compositions, they can be added to enhance release properties. The fatty acids useful in accordance with the present invention are long chain fatty acids such as $C_{10}$–$C_{24}$ saturated, mono-unsaturated or di-unsaturated carboxylic acids which are liquids at room temperature. Preferred long chain fatty acids are mono-unsaturated $C_{16}$–$C_{20}$ carboxylic acids which are liquids at room temperature. Examples of useful fatty acids include, but are not limited to, palmitic acid, stearic acid, myristic acid, lauric acid, oleic acid, linoleic acid, and linolenic acid. A particularly useful fatty acid is oleic acid. The fatty acid portion of the formulation can range from 0 to 10% based on weight. Typical amounts of fatty acid will range from 1 to 3% by weight.

Organophylic clays for years have provided viscosities and suspending properties required of drilling muds. The pattern coating composition of certain embodiments of this invention borrows from this drilling mud art. Consequently, organophylic clays themselves are well known. They are prepared by treating a clay with an amine or an amine salt. Usually the clay-amine reaction is effected by mixing a clay dispersion with about 50 to 200 milliequivalents of amine per 100 grams of clay. Amines which can be incorporated in the emulsion, or which can be reacted with the clays to form organophylic-emulsifying agents are high molecular weight straight chain and cyclic aliphatic amines. Desirable amines are those having six to twenty four carbon atoms in the alkyl chains, for example, hexyl amine, heptyl amine, decyl amine, undecyl amine, tridecyl amine, pentadecyl amine, heptadecyl amine, cetyl amine, and cyclic tertiary amines such as tall oil or cottonseed oil imidazolines as well as their salts.

The clays normally utilized in the preparation of organophylic clays and hence those preferred herein are those containing aluminum and magnesium atoms along with the silica which is characteristic of such clays. This includes such clays as bentonite, attapulgite, sepiolite and palygorskite, but excludes muscovite or mica and kaolinitic clays. Again, it will be appreciated that the organophylic clays can be prepared in situ. Thus, in addition to incorporating, for example, octadecylammonium bentonite in a vegetable oil-water mixture, bentonite and octadecyl amine acetate can be included to the mixture to form the desired emulsion.

The pattern coating composition of the present invention is applied in an amount sufficient to provide the desired release properties from the casting pattern. Typically, this will correspond to a coating thickness of from about 2 to about 10 mils. In accordance with particular embodiments of the present invention, the coating is applied at a coating thickness of from about 6 to 8 mils. Of course, additional material can be applied to increase release properties.

The pattern coating composition of the present invention is advantageous in that it is biodegradable. Vegetable oils and alcohols are highly degradable, particularly under aerobic conditions. Accordingly, the biodegradable pattern coating compositions of the present invention are more environmentally friendly than the prior art petroleum hydrocarbon based compositions.

Having given the teachings of this invention, it will now be illustrated by means of specific examples.

EXAMPLE 1

An emulsion is prepared using corn oil and water to form the following composition.

| MATERIAL | PARTS BY WEIGHT |
|---|---|
| Corn oil | 4000 |
| Water | 4000 |
| Amine* | 200 |
| Bentonite | 200 |

*1-hydroxyethyl-2-tall oil imidazoline

The above materials, when mixed in an ordinary mixer, produce a stable emulsion, which is not affected by cold or hot temperatures. When frozen, the material returns to a stable emulsion after minor mixing. When used on the pattern face in a green sand molding facility the product gives excellent results.

Even though a desirable, stable emulsion is formed by the procedure of Example 1, at times it will be desirable to incorporate certain additives in the composition. This is illustrated by the example which follows.

EXAMPLE 2

Following the procedure of Example 1 a parting composition was made using the same materials plus additional ingredients to further improve the stability and application properties of the product. The ingredients were as follows:

| MATERIAL | PARTS BY WEIGHT |
|---|---|
| Corn oil | 4600 |
| Water | 4730 |
| Bentonite | 230 |
| Amine* | 230 |
| Isopropanol | 230 |
| Oleic acid | 100 |

*Amino = Octadecyl amine acetate

When used in an ordinary mixer, the foregoing ingredients produce a stable emulsion which is not affected by cold or hot temperatures. When frozen, the material returns to a stable emulsion after minor mixing when applied to the pattern face in a green sand molding facility. The composition will wet the surface of the pattern with an improved efficiency.

EXAMPLE 3

Following Example 1 a pattern coating composition was prepared using additional ingredients.

| MATERIAL | PARTS BY WEIGHT |
|---|---|
| Corn oil | 4550 |
| Water | 4550 |
| Diisopropanol | 230 |
| Hexamine | 340 |
| Attapulgite | 230 |
| Oleic acid | 100 |
| Isopropanol | 230 |

This composition has the advantage that it will require less mixing action in an ordinary mixer to form a stable emulsion.

EXAMPLE 4

Following Example 1 a sand casting pattern coating was prepared using the following ingredients:

| MATERIAL | PARTS BY WEIGHT |
|---|---|
| Corn oil | 2000 |
| Water | 2000 |
| Isopropanol | 100 |
| Oleic acid | 50 |
| Organophylic clay* | 100 |

*Octadecylammonium bentonite

The foregoing materials when mixed in an ordinary mixer produce a stable emulsion which is not affected by cold or hot temperatures. When frozen, the material returns to a stable emulsion after minor mixing. When used on the pattern face in a facility the product gives excellent results, yielding castings which are extremely smooth.

EXAMPLE 5

COMPARATIVE

A presently manufactured product in the industry has the following composition:

| MATERIAL | PARTS BY WEIGHT |
|---|---|
| Mineral seal oil | 970 |
| Oleic acid | 30 |

This product was tested by a commercial testing laboratory and was found to have a Flash Point of 129° to 135° C. The parting composition of Example 3 when similarly tested did not have a flash point on heating to 100° C., and at that point the water vapor extinguished the flame. As a pattern coating composition, the formula of Example 3 was superior to that of Example 5 because of the inclusion of the clay-amine compound.

EXAMPLE 6

A sand casting pattern coating was prepared using the following ingredients:

| MATERIAL | PARTS BY WEIGHT |
|---|---|
| Corn oil | 4750 |
| Ethanol | 250 |

This composition has the advantage over example 5 that it will require less material for the application as a pattern coating and a higher flash point of greater than 300° F. Since the metal casting industry is based upon molten metal used in the facility, higher flash points are preferred. In addition, this composition has the advantage that it does not require the addition of oleic acid.

EXAMPLE 7

A sand casting pattern coating was prepared using the following ingredients:

| MATERIAL | PARTS BY WEIGHT |
|---|---|
| Corn oil | 3500 |
| Mineral seal oil | 1500 |

This composition has the advantage over example 5 that it will require less material for the application as a pattern coating. In addition, this composition has the advantage that it does not require the addition of oleic acid.

EXAMPLE 8

A sand casting pattern coating was prepared using the following ingredients:

| MATERIAL | PARTS BY WEIGHT |
|---|---|
| Corn oil | 2500 |
| Mineral seal oil | 2500 |

This composition has the advantage over example 7 that it has a lower viscosity and would result in easier application.

EXAMPLE 9

A sand casting pattern coating was prepared using the following ingredients:

| MATERIAL | PARTS BY WEIGHT |
|---|---|
| Corn oil | 2375 |
| Mineral seal oil | 2375 |
| Ethanol | 250 |

This composition has the advantage over example 8 in that it has yet a lower viscosity and would result in easier application, but would have a lower flash point.

EXAMPLE 10

A sand casting pattern coating was prepared using the following ingredients:

| MATERIAL | PARTS BY WEIGHT |
|---|---|
| Corn oil | 1500 |
| Mineral seal oil | 3500 |

This composition has the advantage over examples 7, 8 and 9 that it has the lowest viscosity that would be preferred when simple spraying applications are employed. For example, this composition would be useful for hand wiping, alternative spray methods, or other methods presently used in the foundry industry.

EXAMPLE 11

A particularly useful sand casting pattern coating was prepared in accordance with the following:

| MATERIAL | PARTS BY WEIGHT |
|---|---|
| Corn oil | 48 |
| Petroleum oil | 48 |
| Alcohol | 2 |
| Fatty Acid | 2 |

The foregoing examples are illustrations of the variety of outstanding sand partings which can be made by this invention. When coatings of from 100 mil to three-sixteenth inch thicknesses are applied adherence to the removed pattern is so minimal that the resulting cavity is devoid of pits and deterioration. Traditionally, solvent systems have been used as parting materials for pattern faces. These compositions generally consisted of an oil solvent along with organic additives such as oleic acid, waxes, paraffin, and the like. The blending of vegetable oil with a viscosity reducer and the emulsification of the vegetable oil with amine-clay mixtures or organophylic clays provides an improved composition without the disadvantages of prior art systems.

Sand casting pattern coatings prepared in accordance with the present invention also provide improved emission characteristics as compared to petroleum based pattern coatings. As indicated in Table 1, sand casting pattern compositions prepared in accordance with the present invention emit significantly less benzene per gram of release agent when tested in accordance with the emission test method for release agents established by the AFS (American Foundrymen's Society). Release agents having emission characteristics of less than 4 mg benzene per gram of release agent are an improvement over the prior art petroleum based sample.

TABLE 1

EMISSION CHARACTERISTICS OF PATTERN COATINGS

| EXAMPLE | MATERIAL | mg BENZENE PER g OF RELEASE AGENT |
|---|---|---|
| 5 (Comparative) | Petroleum Based Liquid Parting | 4.25 |
| 6 | Vegetable Oil Base Liquid Parting | 2.61 |
| 9 | Blended Petroleum and Vegetable Oil Based Liquid Parting | 3.35 |
| 1 | Water Based Liquid Parting | 0.37 |

The sand casting pattern coatings of the present invention also provide reduced VOC's as measured by EPA method 24. Furthermore, the sand pattern coatings in accordance with the present invention are biodegradable whereas the petroleum based coatings of the prior art are not. Data relating to VOC and biodegradability are provided in Table 2 along with other characteristics of the pattern coatings of the present invention (Examples 1, 6 and 9) compared to prior art petroleum based coatings (Example 5).

TABLE 2

CHARACTERISTICS OF PATTERN COATINGS

| EXAMPLE | 5 (COMPARATIVE) | 6 | 9 | 1 |
|---|---|---|---|---|
| Physical Property | Petroleum Based Liquid Parting | Vegetable Oil Based Liquid Parting | Blended Petroleum and Vegetable Oil Based Liquid Parting | Water Based Liquid Parting |
| Flash Point in F Closed Cup | 275 | Greater than 200 | Greater than 250 | Water Vapor Ext. Flame |
| Viscosity (cps) | 10 | 47 | 15 | 167 |
| Specific Gravity | 0.8 | 0.9 | 1.86 | 0.9 |
| VOC (lbs/gal) Method 24 | 4.2 | 0.29 | 2.9 | 3.6 |
| Biodegradability | No | Yes | Yes | Not Determined |
| Biodegradability ½ life in days | 91 | 15–23 | 21 | Not Determined |

As the examples show, various modifications are possible within the spirit of this invention. In addition to ingredients illustrated, such additives as surfactants, either anionic, cationic or nonanionic and other emulsifying agents can be employed. It has already been emphasized that either the organophylic clay or the amine and the clay can be incorporated in the composition during the mixing stage. These and other ramifications will occur to those skilled in the art. Such variations are deemed to be within the scope of this invention.

What is claimed is:

1. In the method of protecting foundry molds from eroding and pitting during sandcasting by preventing adherence of molding sand to mold pattern surfaces, wherein a pattern coating composition is applied to the mold pattern surfaces in an amount sufficient to form a coating thereon which prevents adherence of sand to the mold pattern, the improvement comprising coating the mold pattern surfaces with a pattern coating composition comprising from about 10% to 99.5% vegetable oil and a viscosity reducer selected from the group consisting of mineral seal oil, alcohol and mixtures thereof.

2. The method of claim 1 wherein said pattern coating composition comprises from about 90% to 10% vegetable oil and 10 to 90% mineral seal oil.

3. The method of claim 2 wherein said pattern coating composition comprises approximately equal parts vegetable oil and mineral seal oil.

4. The method of claim 2 wherein said pattern coating composition further comprises alcohol.

5. The method of claim 4 wherein said alcohol is present from about 0.5 to 10% by weight of the composition.

6. The method of claim 1 wherein said viscosity reducer comprises alcohol.

7. The method of claim 6 wherein said pattern coating composition comprises from about 90% to 99.5% vegetable oil and about 0.5% to 10% alcohol.

8. The method of claim 1 wherein said vegetable oil is selected from the group consisting of corn oil, sesame oil, rapeseed oil, sunflower oil, palm oil, coconut oil, peanut oil, soybean oil, canola oil and mixtures thereof.

9. The method of claim 8 wherein said vegetable oil comprises corn oil.

10. The method of claim 6 wherein said alcohol is selected from the group consisting of ethanol, propanol, butanol and combinations thereof.

11. The method of claim 10 wherein said alcohol comprises ethanol.

12. The method of claim 11 wherein said vegetable oil comprises corn oil.

13. The method of claim 1 wherein said pattern coating composition further comprises a long chain fatty acid selected from the group consisting of palmitic acid, stearic acid, myristic acid, lauric acid, oleic acid, linoleic acid, linolenic acid and mixtures thereof.

14. The method of claim 13 wherein said long chain fatty acid comprises oleic acid.

15. The method of claim 14 wherein said viscosity reducer comprises a mixture of mineral seal oil and alcohol.

16. The method of claim 15 wherein said vegetable oil and said mineral seal oil are present in said composition in approximately equal parts.

17. A method for facilitating release of molding sand from mold pattern surfaces comprising applying to the mold pattern surfaces an effective amount of a biodegradable pattern coating composition, wherein the biodegradable pattern coating composition comprises from about 10% to 99.5% vegetable oil;

a viscosity reducer selected from the group consisting of petroleum oil, alcohol, and mixtures thereof, and optionally a fatty acid.

18. The method of claim 17 wherein said pattern coating composition has a volatile organic compound (VOC) content of less than 3.8 lbs/gal as measured by EPA method 24.

19. The method of claim 17 wherein said pattern coating composition emits less than 4.0 mg benzene per gram of the composition when tested in accordance with the AFS emission test method for release coatings.

20. The method of claim 17 wherein said pattern coating composition comprises approximately equal parts vegetable oil and petroleum oil.

21. The method of claim 20 wherein said pattern coating composition further comprises oleic acid and alcohol.

22. The method of claim 21 wherein said vegetable oil comprises corn oil and said petroleum oil comprises mineral seal oil.

* * * * *